US007848538B2

(12) United States Patent
Ishigaki et al.

(10) Patent No.: US 7,848,538 B2
(45) Date of Patent: Dec. 7, 2010

(54) SPEAKER VOICE COIL AND SPEAKER UNIT USING THE SAME

(75) Inventors: Toshihiro Ishigaki, Yamagata (JP); Seiya Sato, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1219 days.

(21) Appl. No.: 11/383,983

(22) Filed: May 18, 2006

(65) Prior Publication Data

US 2006/0262956 A1 Nov. 23, 2006

(30) Foreign Application Priority Data

May 18, 2005 (JP) ..... 2005-145154
Nov. 21, 2005 (JP) ..... 2005-335462

(51) Int. Cl.
*H04R 1/00* (2006.01)

(52) U.S. Cl. ..... 381/410; 381/400

(58) Field of Classification Search ..... 381/400, 381/406–407, 409–410
See application file for complete search history.

(56) References Cited

U.S. PATENT DOCUMENTS 3,963,882 A * 6/1976 Lewis ..... 29/605
6,421,449 B1 * 7/2002 Hasegawa et al. ..... 381/401
7,729,503 B2 * 6/2010 Young ..... 381/407

FOREIGN PATENT DOCUMENTS

JP 08-168095 A 6/1996

* cited by examiner

*Primary Examiner*—Curtis Kuntz
*Assistant Examiner*—Ryan Robinson
(74) *Attorney, Agent, or Firm*—Arent Fox, LLP

(57) ABSTRACT

A thread winding part or a reinforcing wire winding part is formed by winding a heat resistant fiber thread or a reinforcing wire around the voice coil bobbin in contact with both coil ends of the wire winding part or a coil end of the same on a magnetic-circuit side. A bent part bent outward is formed on the lower end of the voice coil bobbin on the magnetic circuit side. This prevents the wire winding part from shifting from its mounting position and from coming off to the lower side. In the resulting voice coil, the wire winding part hardly comes off the voice coil bobbin even if the wire binding of the wire winding part is loosened by Joule heat, speaker vibrations, etc.

8 Claims, 6 Drawing Sheets

SPEAKER VOICE COIL AND SPEAKER UNIT USING THE SAME

CROSS-REFERENCE TO RELATED APPLICATION

This application claims the priority of JP Application No. 2005-145154, filed May 18, 2005, and JP Application No. 2005-335462, filed Nov. 21, 2005, the entire specifications, claims and drawings of which are incorporated herewith by reference.

BACKGROUND OF THE INVENTION

The present invention relates to a speaker voice coil and a speaker unit using the same.

As shown in FIG. 1, a speaker voice coil 10 conventionally has a wire winding part 12 which is made of a single or plurality of layers of wire 12A wound around a voice coil bobbin 11. The voice coil bobbin 11 has a film-like or cylindrical shape, being made of kraft paper, a metal film such as titanium and aluminum, or a heat resistant sheet such as a polyimide film. The wire 12A is a conductor such as copper, aluminum, and copper-clad aluminum, covered with a resin coating (insulating coating or adhesive coating).

The conventional speaker voice coil described above has had the following problem. That is, the voice coil 10 structurally has a low efficiency in converting an input electric signal into an acoustic signal. When high power is input to the voice coil 10, an electric current flowing through the wire 12A therefore generates a large amount of Joule heat. This gives rise to the problem that the resin coating that covers the wire 12A is gradually melted or decomposed by heat, and the binding between the voice coil bobbin 11 and the wire winding part 12 and the binding between the turns of the wire 12A become loose.

Losing tight binding with the voice coil bobbin 11 or between the turns of the wire 12A, the wire winding part 12 can shift from its predetermined mounting position due to amplitude operations of the speaker, and cause such failures as disconnection and coming off the voice coil bobbin 11.

In order to solve this problem, there have been proposed such methods as shown in FIGS. 2A to 2C. In the method of FIG. 2A, the voice coil bobbin 11 and both upper and lower ends (coil ends) of the wire winding part 12 are fixed with an adhesive 13. In the method of FIG. 2B, the lower end of the voice coil bobbin 11 is bent outward in advance. In the method of FIG. 2C, the lower end of the voice coil bobbin 11 is bent outward to form a U-sectioned accommodating part 14, in which after the wire winding part 12 is accommodated, the accommodating part 14 is filled with an adhesive 13 for sealing (for example, see Japanese Patent Application Laid-Open No. Hei 08-168095).

According to the first method, however, the adhesive 13 can suffer damage such as heat melting, heat decomposition, and deterioration from Joule heat that is generated by the current flowing through the wire 12A to the adhesive 13. The reinforcing effect then disappears under high-temperature environment.

According to the second method, if the voice coil bobbin 11 is made of conductive material, eddy currents can occur with a problem of increased mechanical resistance.

According to the third method, there is the problem that the usage of the adhesive 13 is high since the entire wire winding part 12 is fixed by the adhesive 13.

Another problem is that it is difficult to bend the end of the voice coil bobbin 11 outward so as to accommodate the entire wire winding part 12. In particular, when the voice coil bobbin 11 is made of a hard metal such as titanium, bending the voice coil bobbin 11 can damage the wire winding part 12 with a problem of short circuit.

SUMMARY OF THE INVENTION

In view of the foregoing, an object of the present invention is to solve the foregoing problems of the conventional techniques, including that the wire winding part formed on the voice coil cannot withstand Joule heat or speaker vibrations and moves to cause disconnection or come off the voice coil bobbin.

To achieve the foregoing object, a speaker voice coil according to the present invention shall comprise at least components set forth in the following aspects.

One aspect of the present invention is a speaker voice coil comprising: a wire winding part formed by winding a resin-coated wire around a voice coil bobbin; and a thread winding part in which a heat resistant fiber thread is wound around the voice coil bobbin in contact with either one or both ends of the wire winding part, and the winding of the heat resistant fiber thread is fixed with a resin material or a coating agent.

Another aspect of the present invention is a speaker voice coil comprising: a wire winding part formed by winding a resin-coated wire around a voice coil bobbin; and a thread winding part in which a heat resistant fiber thread is wound around the voice coil bobbin in contact with one end of the wire winding part, and the wire winding part is covered with the heat resistant fiber thread.

Still another aspect of the present invention is a speaker voice coil comprising: a wire winding part formed by winding a resin-coated wire around a voice coil bobbin; and a reinforcing wire winding part in which a reinforcing wire non-conductive with the wire is wound around the voice coil bobbin in contact with either one or both ends of the wire winding part, and the winding of the reinforcing wire is fixed by heat treatment, by solvent treatment, or with an adhesive.

Further another aspect of the present invention is a speaker voice coil comprising: a wire winding part formed by winding a resin-coated wire around a voice coil bobbin; and a reinforcing wire winding part in which a reinforcing wire non-conductive with the wire is wound around the voice coil bobbin in contact with one end of the wire winding part, the winding of the reinforcing wire is fixed by heat treatment, by solvent treatment, or with an adhesive, and the wire winding part is covered with the reinforcing wire.

Still another aspect of the present invention is a speaker voice coil comprising: a wire winding part formed by winding a resin-coated wire around a voice coil bobbin; and a thread winding part in which a heat resistant fiber thread is wound around the voice coil bobbin in contact with one end of the wire winding part, and the winding of the heat resistant fiber thread is fixed with a resin material or a coating agent, and wherein an end of the voice coil bobbin is bent outward.

Still another aspect of the present invention is a speaker voice coil comprising: a wire winding part formed by winding a resin-coated wire around a voice coil bobbin; and a reinforcing wire winding part in which a reinforcing wire non-conductive with the wire is wound around the voice coil bobbin in contact with one end of the wire winding part, and the winding of the reinforcing wire is fixed by heat treatment, by solvent treatment, or with an adhesive, and wherein an end of the voice coil bobbin is bent outward.

Thus, the speaker voice coil having the wire winding part that is less prone to shifting from its initial mounting position due to such reasons as Joule heat and speaker vibrations is achieved by winding the heat resistant fiber thread or the reinforcing wire around the voice coil bobbin in contact with the coil end(s) of the wire winding part.

Moreover, the speaker voice coil having the wire winding part that hardly comes off is achieved by winding the heat resistant fiber thread or the reinforcing wire around the voice coil in contact with the coil end(s) of the wire winding part, and bending the coil end of the voice coil bobbin on the magnetic-circuit side outward.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
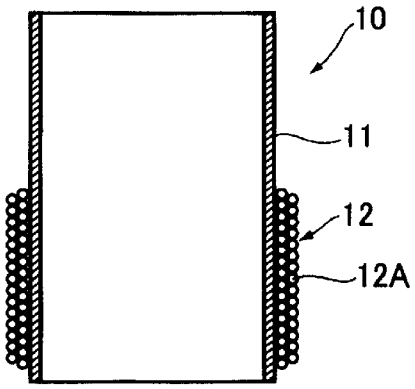
FIG.1 PRIOR ART
FIG. 1 is a sectional view of a conventional speaker voice coil.
Figure 2A:
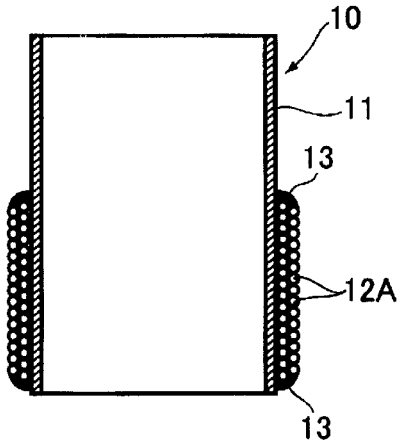
FIG.2 A PRIOR ART
FIGS. 2A to 2C are sectional views of voice coils that have conventional measures for preventing movement of a winding part.
Figure 2B:
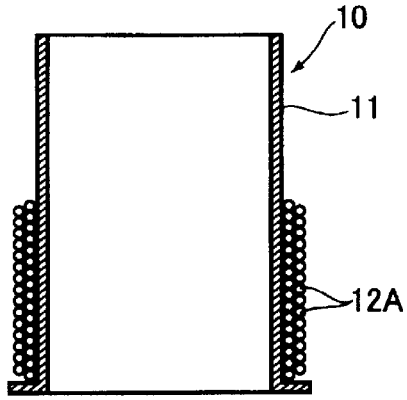
FIG.2 B PRIOR ART
Figure 2C:
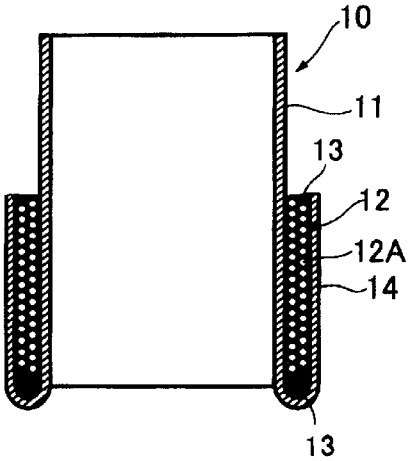
FIG.2 C PRIOR ART

Hereinafter, most preferred embodiments of the present invention will be described in detail with reference to the drawings.

As shown in FIGS. 4, 5, and 7 to 11C, each embodiment of the present invention is based on a speaker voice coil which comprises a voice coil body 20 having a wire winding part 22 formed by winding a resin-coated wire 22A around a voice coil bobbin 21.

A first embodiment is characterized by having a thread winding part 23. In the thread winding part 23, a heat resistant fiber thread 23A is wound around the voice coil bobbin 21 in contact with either one or both ends of the wire winding part 22. The winding of the heat resistant fiber thread 23A is fixed with a resin material or a coating agent.

A second embodiment is characterized by having a thread winding part 231. In the thread winding part 231, the heat resistant fiber thread 23A is wound around the voice coil bobbin 21 in contact with one end of the wire winding part 22. The wire winding part 22 is covered with the heat resistant fiber thread 23A.

In addition to the configuration of the second embodiment, a third embodiment is characterized in that the heat resistant fiber thread 23A is wound around the voice coil bobbin 21 in contact with the other end of the wire winding part 22.

A fourth embodiment is characterized by having a reinforcing wire winding part 24. In the reinforcing wire winding part 24, a reinforcing wire 24A nonconductive with the wire 22A is wound around the voice coil bobbin 21 in contact with either one or both ends of the wire winding part 22. The winding of the reinforcing wire 24A is fixed by heat treatment, by solvent treatment, or with an adhesive.

A fifth embodiment is characterized by having a reinforcing wire winding part 241. In the reinforcing wire winding part 241, the reinforcing wire 24A nonconductive with the wire 22A is wound around the voice coil bobbin 21 in contact with one end of the wire winding part 22. The winding of the reinforcing wire 24A is fixed by heat treatment, by solvent treatment, or with an adhesive. The wire winding part 22 is covered with the reinforcing wire 24A.

In addition to the configuration of the fifth embodiment, a sixth embodiment is characterized in that: the reinforcing wire 24A is wound around the voice coil bobbin 21 in contact with the other end of the wire winding part 22; and the winding of the reinforcing wire 24A is fixed by heat treatment, by solvent treatment, or with an adhesive.

In addition to the configuration of the fourth or fifth embodiment, a seventh embodiment is characterized in that the reinforcing wire 24A is a self-fusing wire having a fusing layer on its periphery.

In addition to the configuration of the fourth or fifth embodiment, an eighth embodiment is characterized in that the reinforcing wire 24A is either a naked wire or an insulated wire.

In addition to the configuration of the first to eight embodiments, a ninth embodiment is characterized in that a bent portion 21A bent outward is formed on one end of the voice coil bobbin 21.

In addition to the configuration of the ninth embodiment, a tenth embodiment is characterized in that the bent portion 21A of the voice coil bobbin 21 is: bent to turn sideways at a near right angle; folded into contact with a winding that is wound in contact with one end of the wire winding part 22, i.e., the thread winding part 23 or 231 or the reinforcing wire winding part 24 or 241; or folded to accommodate a winding that is wound in contact with one end of the wire winding part 22, i.e., the thread winding part 23 or 231 or the reinforcing wire winding part 24 or 241.

An eleventh embodiment is characterized by having a thread winding part 23. In the thread winding part 23, a heat resistant fiber thread 23A is wound around the voice coil bobbin 21 in contact with one end of the wire winding part 22. The winding of the heat resistant fiber thread 23A is fixed with a resin material or a coating agent. Moreover, a bent portion 21A bent outward is formed on an end of the voice coil bobbin 21.

A twelfth embodiment is characterized by having a reinforcing wire winding part 24. In the reinforcing wire winding part 24, a reinforcing wire 24A nonconductive with the wire 22A is wound around the voice coil bobbin 21 in contact with one end of the wire winding part 22. The winding of the reinforcing wire 24A is fixed by heat treatment, by solvent treatment, or with an adhesive. Moreover, a bent portion 21A bent outward is formed on an end of the voice coil bobbin 21.

In addition to the configuration of the twelfth embodiment, a thirteenth embodiment is characterized in that the reinforcing wire 24A is a self-fusing wire having a fusing layer on its periphery.

In addition to the configuration of the twelfth embodiment, a fourteenth embodiment is characterized in that the reinforcing wire 24A is either a naked wire or an insulated wire.

In addition to the configuration of any one of the eleventh to fourteenth embodiments, a fifteenth embodiment is characterized in that the bent portion 21A on the end of the voice coil bobbin 21 is: bent to turn sideways at a near right angle; folded into contact with a winding that is wound in contact with one end of the wire winding part 22, i.e., the thread winding part 23 or 231 or the reinforcing wire winding part 24 or 241; or folded to accommodate a winding that is wound in contact with one end of the wire winding part 22, i.e., the thread winding part 23 or 231 or the reinforcing wire winding part 24 or 241.

In addition to the configuration of any one of the ninth to fifteenth embodiments, a sixteenth embodiment is characterized in that the bent portion 21A of the voice coil bobbin 21 has slits 21A1.

A seventeenth embodiment is characteristically a speaker unit which uses any one of voice coils 200 to 211 according to the first to sixteenth embodiments.

According to the characteristics of the first embodiment, there is provided the thread winding part 23 in which the heat resistant fiber thread 23A is wound around the voice coil bobbin 21 in contact with one or both ends of the wire winding part 22 of the voice coil bobbin 21. The winding is fixed with a resin material or a coating agent. The wire winding part 22 is thus prevented from shifting from its initial mounting position, i.e., its predetermined mounting position. In the resulting voice coil 200, the possibility for the wire winding part 22 to cause disconnection or come off the voice coil bobbin 21 is reduced significantly even if the voice coil 200 generates heat due to high input until the resin coating of the wire 22A is thermally broken and the wire binding of the wire winding part 22 becomes loose.

Since the heat resistant fiber thread 23A is wound around the voice coil bobbin 21, the voice coil 200 improves in rigidity and can suppress split resonance. The manufacturing cost can also be reduced because the lower end of the voice coil bobbin 21 need not be bent outward.

It is also possible to reduce adhesive usage significantly and cut down the cost.

According to the characteristics of the second or third embodiment, there is provided the thread winding part 231 in which the heat resistant fiber thread 23A is wound around the voice coil bobbin 21 in contact with one or both ends of the wire winding part 22 of the voice coil bobbin 21. The wire winding part 22 is covered with the heat resistant fiber thread wound around the voice coil bobbin 21. Consequently, the wire winding part 22 is firmly held at one end or both ends by the thread winding part 231, and is thus prevented from shifting from its initial mounting position. In the resulting voice coil 201, the possibility for the wire winding part 22 to cause disconnection or come off the voice coil bobbin 21 is reduced significantly even if the voice coil 201 generates heat due to high input until the wire binding of the wire winding part 22 becomes loose.

Even if the resin coating on the wire 22A of the wire winding part 22 is heated by Joule heat, heat decomposition gas caused by the wire 22A is released to the air through gaps between the turns of the heat resistant fiber thread 23A in the thread winding part 231. This precludes the thread winding part 231 from bulging out.

Since the wire winding part 22 is covered with the heat resistant fiber thread 23A, pits and projections on the periphery of the wire winding part 22 can be absorbed to form a tightly-fitted three-dimensional reinforcement. This also makes it possible to form the voice coil 201 into any shape.

Since the heat resistant fiber thread 23A is wound around the voice coil bobbin 21, the voice coil 201 has improved rigidity and can suppress split resonance. The manufacturing cost can also be reduced because the lower end of the voice coil bobbin 21 need not be bent outward. Troubles ascribable to bobbin machining, such as deformation of the bobbin coil, can also be prevented from occurring.

It is also possible to reduce adhesive usage significantly and cut down the cost.

According to the characteristics of the fourth embodiment, there is provided the reinforcing wire winding part 24 in which the reinforcing wire 24A nonconductive with the wire 22A is wound around the voice coil bobbin 21 in contact with either one or both ends of the wire winding part 22. The winding of the reinforcing wire 24A is fixed by heat treatment, by solvent treatment, or with an adhesive. Consequently, the wire winding part 22 is firmly held at one end or both ends by the reinforcing wire winding part 24, and is thus prevented from shifting from its initial mounting position. In the resulting voice coil 202, the possibility for the wire winding part 22 to cause disconnection or come off the voice coil bobbin 21 is reduced significantly even if the voice coil 202 generates heat due to high input until the wire binding of the wire winding part 22 becomes loose.

Since the reinforcing wire 24A is wound around the voice coil bobbin 21, the voice coil 202 has improved rigidity and can suppress split resonance. The manufacturing cost can also be reduced because the lower end of the voice coil bobbin 21 need not be bent outward.

It is also possible to reduce adhesive usage significantly and cut down the cost.

According to the characteristics of the fifth to seventh embodiments, there is provided the reinforcing wire winding part 241 in which a self-fusing wire is wound as the reinforcing wire 24A nonconductive with the wire 22A, around the voice coil bobbin 21 in contact with one or both ends of the wire winding part 22 of the voice coil bobbin 21. The winding of the self-fusing wire is fixed by heat treatment or by solvent treatment. Besides, the wire winding part 22 is covered with the self-fusing wire wound around the voice coil bobbin 21. Consequently, the wire winding part 22 is firmly held at one end or both ends by the self-fusing wire, and is thus prevented from shifting from its initial mounting position. In the resulting voice coil 203, the possibility for the wire winding part 22 to cause disconnection or come off the voice coil bobbin 21 is reduced significantly even if the voice coil 203 generates heat due to high input until the wire binding of the wire winding part 22 becomes loose.

Since the self-fusing wire is wound around the voice coil bobbin 21, the voice coil 203 has improved rigidity and can suppress split resonance. The manufacturing cost can also be reduced because the lower end of the voice coil bobbin 21 need not be bent outward.

It is also possible to reduce adhesive usage significantly and cut down the cost.

According to the characteristics of the eighth embodiment, there is provided the reinforcing wire winding part 241 in which a naked wire or an insulated wire is wound as the reinforcing wire 24A nonconductive with the wire 22A, around the voice coil bobbin 21 in contact with one or both ends of the wire winding part 22 of the voice coil bobbin 21. The winding of the reinforcing wire 24A is fixed with an adhesive. Besides, the wire winding part 22 is covered with the naked wire or the insulated wire wound around the voice coil bobbin 21. Consequently, the wire winding part 22 is firmly held at one end or both ends by the naked wire or the insulated wire, and is thus prevented from shifting from its initial mounting position. In the resulting voice coil 203, the possibility for the wire winding part 22 to cause disconnection or come off the voice coil bobbin 21 is reduced significantly even if the voice coil 203 generates heat due to high input until the wire binding of the wire winding part 22 becomes loose.

Since the naked wire or the insulated wire is wound around the voice coil bobbin 21, the voice coil 203 has improved rigidity and can suppress split resonance. The manufacturing cost can also be reduced because the lower end of the voice coil bobbin 21 need not be bent outward.

It is also possible to reduce adhesive usage significantly and cut down the cost.

According to the characteristics of the ninth embodiment, the bent portion 21A bent outward is formed on one end of the voice coil bobbin 21. This bent portion 21A prevents the wire winding part 22 from coming off to that side. Consequently, in addition to the operation and effect of the first to eight embodiments, the voice coil bobbin 21 is provided with a structure more resistant to the coming-off of the wire winding part 22. In the resulting voice coils 204 to 206, the wire winding part 22 hardly causes disconnection or comes off the voice coil bobbin 21 even if the voice coils 204 to 206 generate heat due to high input until the wire binding of the wire winding part 22 becomes loose.

According to the characteristics of the tenth embodiment, the bent portion 21A of the voice coil bobbin 21 is: bent to turn sideways at a near right angle; folded into contact with the winding wound in contact with one end of the wire winding part 22, i.e., the thread winding part 23 or 231 or the reinforcing wire winding part 24 or 241; or folded to accommodate the winding wound in contact with one end of the wire winding part 22, i.e., the thread winding part 23 or 231 or the reinforcing wire winding part 24 or 241. In addition to the operation and effect of the ninth embodiment, there is no need to bend the voice coil bobbin 21 so as to accommodate the entire wire winding part 22. The outward bend on the end of the voice coil bobbin 21 can thus be formed without much increase in manufacturing cost.

Moreover, even if the voice coil bobbin 21 is made of a hard metal such as titanium, the voice coil bobbin 21 can be bent without damaging the wire winding part 22.

According to the characteristics of the eleventh embodiment, there is provided the thread winding part 23 in which the heat resistant fiber thread 23A is wound around the voice coil bobbin 21 in contact with one end of the wire winding part 22 of the voice coil bobbin 21. The winding is fixed with a resin material or a coating agent. Moreover, the bent portion 21A bent outward is formed on the end of the voice coil bobbin 21. This bent portion 21A prevents the wire winding part 22 from coming off to that side. Consequently, the voice coil bobbin 21 is provided with a structure more resistant to the coming-off of the wire winding part 22 of the voice coil bobbin 21. In the resulting voice coil, the wire winding part 22 hardly causes disconnection or comes off the voice coil bobbin 21 even if the voice coil generates heat due to high input until the wire binding of the wire winding part 22 becomes loose.

According to the characteristics of the twelfth embodiment, there is provided the reinforcing wire winding part 24 in which the reinforcing wire 24A nonconductive with the wire 22A is wound around the voice coil bobbin 21 in contact with one end of the wire winding part 22. The winding of the reinforcing wire 24A is fixed by heat treatment, by solvent treatment, or with an adhesive. Moreover, the bent portion 21A bent outward is formed on the end of the voice coil bobbin 21. This bent portion 21A prevents the wire winding part 22 from coming off to that side. Consequently, the voice coil bobbin 21 is provided with a structure more resistant to the coming-off of the wire winding part 22. In the resulting voice coil, the wire winding part 22 hardly causes disconnection or comes off the voice coil bobbin 21 even if the voice coil generates heat due to high input until the wire binding of the wire winding part 22 becomes loose.

According to the characteristics of the thirteenth embodiment, the winding of the self-fusing wire, or the reinforcing wire 24A, is fixed by heat treatment or by solvent treatment. Consequently, in addition to the operation and effect of the twelfth embodiment, the voice coil improves in rigidity and can suppress split resonance. It is also possible to reduce adhesive usage significantly and cut down the cost.

According to the characteristics of the fourteenth embodiment, the winding of the naked wire or the insulated wire, i.e., the reinforcing wire 24A is fixed with an adhesive. Consequently, in addition to the operation and effect of the twelfth embodiment, the voice coil improves in rigidity and can suppress split resonance. It is also possible to reduce adhesive usage significantly and cut down the cost.

According to the characteristics of the fifteenth embodiment, the bent portion 21A is: bent to turn sideways at a near right angle; folded into contact with the winding that is wound in contact with the other end of the wire winding part 22; or folded to accommodate the winding that is wound in contact with the other end of the wire winding part 22. Consequently, in addition to the operation and effect of the eleventh to fourteenth embodiments, there is no need to bend the voice coil bobbin 21 so as to accommodate the entire wire winding part 22. In the resulting voice coils 204 to 209, the outward bend on the end of the voice coil bobbin 21 can be formed without much increase in manufacturing cost.

Moreover, even if the voice coil bobbins 21 of the voice coils 204 to 209 are made of a hard metal such as titanium, the voice coil bobbins 21 can be bent without damaging the wire winding parts 22.

According to the characteristics of the sixteenth embodiment, the bent portion 21A has the slits 21A1. In addition to the operation and effect of the ninth to fifteenth embodiments, this can avoid the occurrence of eddy currents and reduce the mechanical resistance significantly if the voice coil bobbin 21 is made of a conductive material. The resulting voice coils 210 and 211 can thus make extremely smooth operations.

Since the slits 21A1 are formed in the end of the voice coil bobbin 21 before making the bent portion 21A, the end of the voice coil bobbin 21 can be folded easily even when the voice coil bobbin 21 is made of a hard metal such as titanium. Moreover, even if the bent portion 21A is formed on the end of the voice coil bobbin 21, the slits 21A1 can reduce the weight of the voice coil bobbin 21.

According to the characteristics of the seventeenth embodiment, the speaker unit uses any one of the voice coils 200 to 211 in which the possibility for the wire winding part 22 to cause disconnection or come off the voice coil bobbin 21 is reduced significantly. It is therefore possible to obtain stable sound quality over a long period of time, with excellent durability and high maximum input. Since the voice coils 200 to 211 have improved rigidity, it is possible to suppress split resonance and obtain reproduced sound with little distortion.

Embodiment 1

Hereinafter, embodiment 1 of the present invention will be described in detail with reference to FIGS. 3 and 4.

Figure 3:
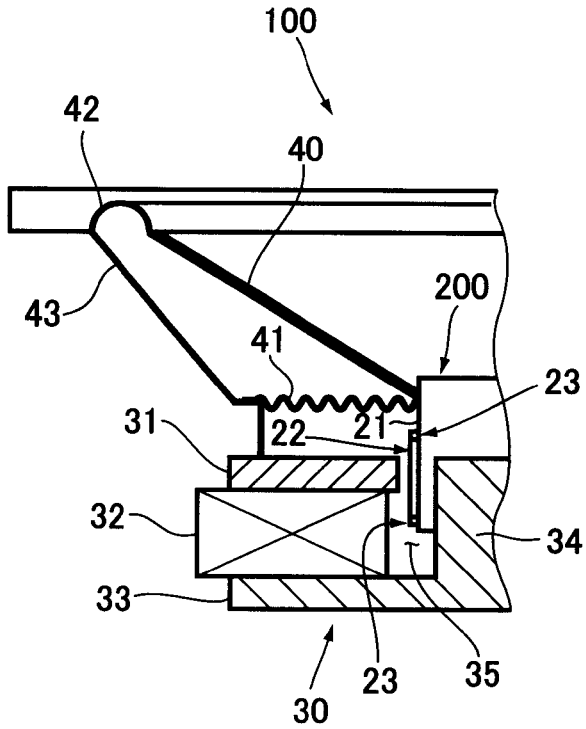
FIG. 3 is a sectional view of a cone speaker having a voice coil according to the present invention.

As shown in FIG. 3, this voice coil 200 is located in a magnetic gap 35 which is formed by the components of a magnetic circuit 30 of a cone speaker 100. The components include an annular plate 31, a magnet 32, a yoke 33, and a center core 34 which is protruded from the central area of the yoke 33. The bottom (cone neck) of a cone-shaped diaphragm 40 and the inner rim of an annular dumper 41 are connected and fixed to an upper side of this voice coil 200 in the diagram. The diaphragm 40 has a dome-shaped edge 42 which is integrally formed on its outer rim. Via the edge 42, the diagram 40 is connected and fixed to the open rim of a frame 43 which is attached to the plate 31. The outer rim of the dumper 41 is connected and fixed to a center step of the frame 43.

Figure 4:
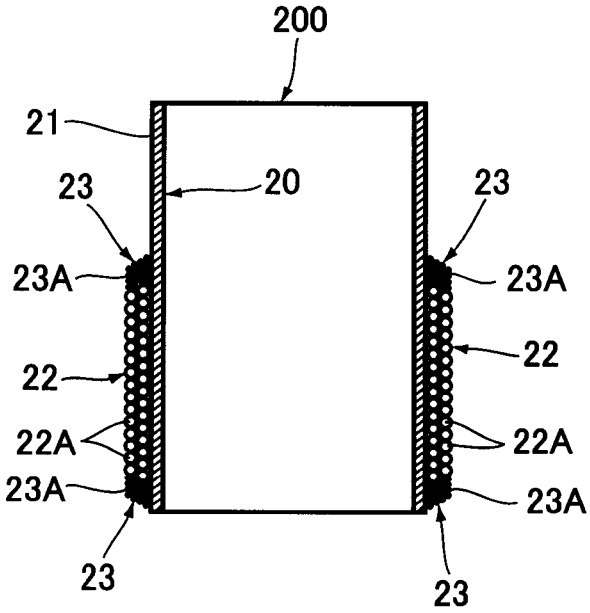
FIG. 4 is a sectional view of the voice coil according to the same embodiment.

As shown in FIGS. 3 and 4, this voice coil 200 has a voice coil body 20 which comprises a voice coil bobbin 21 of cylindrical shape and a wire winding part 22. The wire winding part 22 is made of a wire 22A which is covered with a resin coating (insulating coating or adhesive coating), and is regularly wound (hereinafter, referred to as wound) around the voice coil bobbin 21 where appropriately spaced from the sides shown to the top and bottom ends in the diagram. This wire winding part 22 is electrically connected to positive and negative input terminals through not-shown leads, respectively.

This voice coil 200 also has thread winding parts 23 which are spaced vertically in the diagram. The thread winding parts 23 are formed by winding a heat resistant fiber thread 23A around the voice coil bobbin 21 into a plurality of layers each, in contact with both coil ends of the wire winding part 22, i.e., both the upper and lower coil ends in the diagram (on the diaphragm side and the magnetic-circuit side) so as to retain the wire winding part 22. The windings of the heat resistant fiber thread 23A are fixed with a not-shown resin material or coating agent.

The thread winding parts 23 are not necessarily limited to the configuration of being formed on both coil ends of the wire winding part 22. For example, only the coil end shown to the bottom in the diagram may be provided with a thread winding part 23.

Examples of the heat resistant fiber thread for making the thread winding parts 23 include liquid crystal polymer fiber threads, aramid fiber threads, carbon fiber threads, metal fiber threads, glass fiber threads, ceramic fiber threads, silicon carbide fiber threads, boron fiber threads, and amorphous fiber threads. Thread winding parts 23 and 231 to be described later may also be made of almost the same fiber threads.

Examples of the resin material include polyamide resin, AS resin, ABS resin, PP resin, polyester resin, polyurethane resin, vinyl chloride resin, polystyrene resin, polycarbonate resin, polyphenylene ether resin, polyphenylene sulfide resin, acryl resin, polyether resin, and adhesives and vanishes made of combinations of these.

The coating agent desirably cures when dried at room temperatures or heated at low temperatures. Examples of the coating agent include ceramic coating agents made of metal alkoxide polymers and inorganic fillers.

When an electric signal is input to the cone speaker 100 having the foregoing voice coil 200, the voice coil 200 vibrates in the magnetic gap 35. The vibrations are transmitted to the diaphragm 40 to convert the electric signal into an acoustic signal. During this conversion, suppose, for example, that the voice coil 200 produces heat due to high input until the resin coating of the wire 22A is thermally broken and the wire binding of the wire winding part 22 or the binding with the voice coil bobbin 21 becomes loose. Even in such cases, the thread winding parts 23 prevents the wire winding part 22 from shifting from its initial mounting position, i.e., its predetermined mounting position. Consequently, in the resulting voice coil 200, the possibility for the wire winding part 22 to cause disconnection or come off the voice coil bobbin 21 is reduced significantly.

Since the heat resistant fiber string 23A is wound around the voice coil bobbin 21, the voice coil 200 has improved rigidity and can suppress split resonance. The manufacturing cost can also be reduced since the lower end of the voice coil bobbin 21 (the end on the magnetic-circuit side) need not be bent outward.

Embodiment 2

Figure 5:
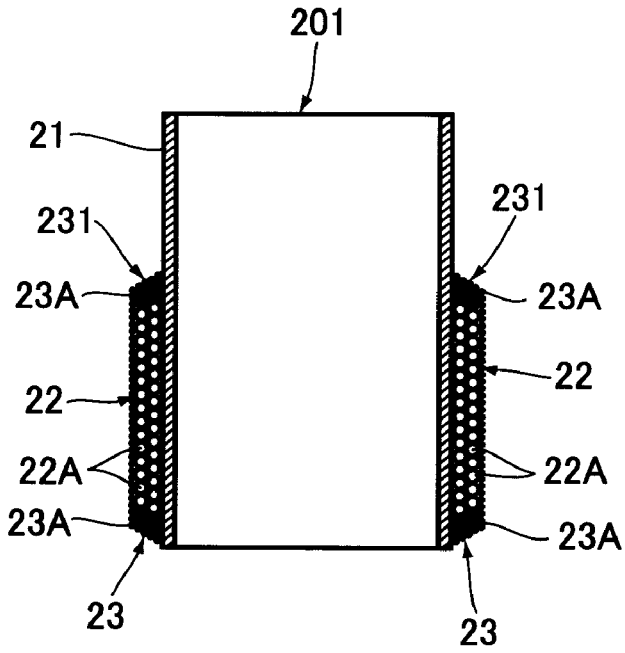
FIG. 5 is a sectional view of a speaker voice coil different from the foregoing embodiment.

Next, embodiment 2 of the present invention will be described in detail with reference to FIG. 5. FIG. 5 is a sectional view of a voice coil different from the foregoing embodiment.

This voice coil 201 has a thread winding part 231 in which the heat resistant fiber thread 23A is wound around the voice coil bobbin 21 in contact with both coil ends of the wire winding part 22 of the voice coil bobbin 21. Besides, the wire winding part 22 is covered with the heat resistant fiber thread 23A wound around the voice coil bobbin 21.

The thread winding part 231 is not necessarily limited to the configuration of covering both coil ends of the wire winding part 22 and the wire winding part 22. For example, the heat resistant fiber thread 23A may be wound around the voice coil bobbin 21 so that it is in contact with the bottom coil end of the wire winding part 22 in the diagram (on the magnetic-circuit side) and covers the wire winding part 22.

According to the foregoing configuration, the wire winding part 22 is firmly held at both coil ends or at the lower end by the thread winding part 231 and is thus prevented from shifting from its initial mounting position. Consequently, the possibility for the wire winding part 22 to cause disconnection or come off the voice coil bobbin 21 is lowered significantly even if the voice coil 201 produces heat due to high input until the resin coating of the wire 22A is thermally broken and the wire binding of the wire winding part 22 or the binding with the voice coil bobbin 21 becomes loose.

Figure 6A:
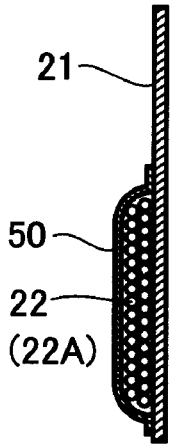
FIGS. 6A to 6C are schematic diagrams showing the states where heat decomposition gas occurs from the wire of the wire winding part.
Figure 6B:
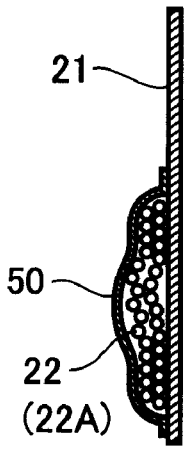
Figure 6C:
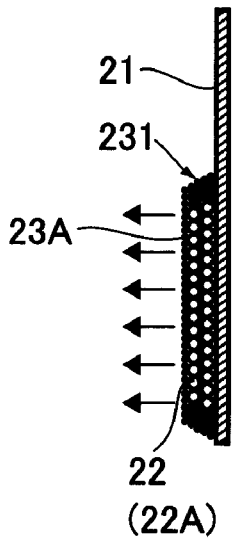

Even if the resin coating of the wire 22A covered with the thread winding part 231 is heated by Joule heat, heat decomposition gas caused by the wire 22A is released to the air through gaps between the turns of the heat resistant fiber thread 23A in the thread winding part 231 as shown in FIG. 6C. This precludes the thread winding part 231 from bulging out. In contrast, there would occur a bulge if the wire winding part 22 were covered with a resin film 50 as shown in FIGS. 6A and 6B.

Since the wire winding part 22 is covered with the heat resistant fiber thread 23A, pits and projections on the periphery of the wire winding part 22 can be absorbed to form a tightly-fitted three-dimensional reinforcement. Moreover, the voice coil 201 can be formed into any shape.

Since the heat resistant fiber thread 23A is wound around the voice coil bobbin 21, the voice coil 201 has improved rigidity and can suppress split resonance. The manufacturing cost can also be reduced sine the lower end of the voice coil bobbin 21 need not be bent outward. Troubles ascribable to bobbin machining, such as deformation of the bobbin coil, canal so be prevented from occurring.

Embodiment 3

Figure 7:
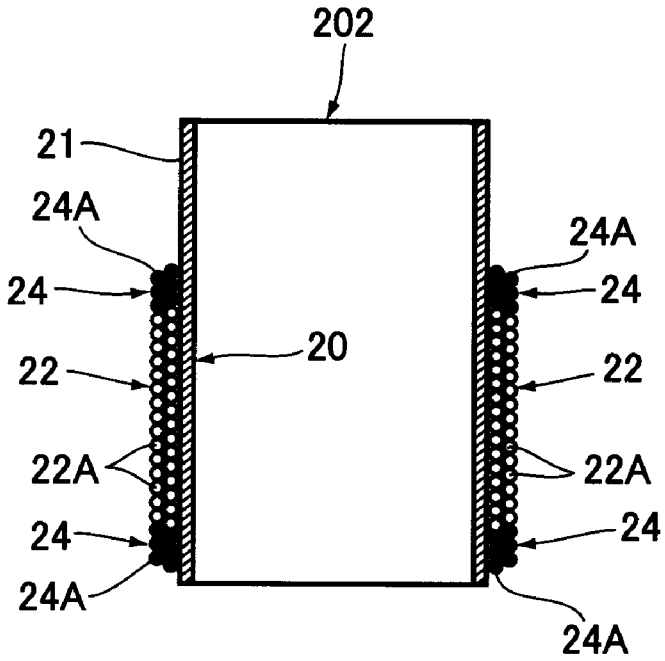
FIG. 7 is a sectional view of a speaker voice coil different from the foregoing embodiment.

Next, embodiment 3 of the present invention will be described in detail with reference to FIG. 7. FIG. 7 is a sectional view of a voice coil different from the foregoing embodiments.

This voice coil 202 has reinforcing wire winding parts 24 in which a reinforcing wire 24A nonconductive with the wire 22A is wound around the voice coil bobbin 21 in contact with both coil ends of the wire winding part 22. The windings of the reinforcing wire 24A are fixed by heat treatment or solvent treatment such as current heating, furnacing, hot-air fusing, and alcohol fusing, or with an adhesive.

The reinforcing wire winding parts 24 are not necessarily limited to the configuration of being formed on both coil ends of the wire winding part 22. For example, only the coil end shown to the bottom in the diagram may be provided with a reinforcing wire winding part 24.

Examples of the reinforcing wire 24A for making the reinforcing wire winding part 24 include a self-fusing wire having a fusing layer on its periphery, a naked wire made of an exposed conductor, and an insulated wire having a conductor covered with an insulating coating.

When a self-fusing wire is used, the winding is fixed by heat treatment or by solvent treatment. When a naked wire or an insulated wire is used, the winding is fixed with an adhesive.

The conductor may have a circular, elliptic, square, or rectangular section.

Examples of the material of the conductor include copper, aluminum, copper-clad aluminum, iron, and stainless steel. Any conductive substance may be used, not limited to the foregoing materials.

The wire material may be either a solid wire made of a single conductor, or a stranded wire made of a plurality of thin conductors.

Moreover, the reinforcing wire 24A need not have a wire diameter, shape, and material equivalent to those of the wire 22A.

According to the foregoing configuration, the wire winding part 22 is firmly held at both coil ends or at the lower coil end by the reinforcing wire winding part(s) 24 and is thus prevented from shifting from its initial mounting position. In the resulting voice coil 202, the possibility for the wire winding part 22 to cause disconnection or come off the voice coil bobbin 21 is reduced significantly even if the voice coil 202 generates heat due to high input until the wire binding of the winding part 22 or the binding with the voice coil bobbin 21 becomes loose.

Since any one of a self-fusing wire, a naked wire, and an insulated wire is wound around the voice coil bobbin 21 as the reinforcing wire 24A, the voice coil 202 has improved rigidity and can suppress split resonance. The manufacturing cost can also be reduced since the lower end of the voice coil bobbin 21 need not be bent outward.

Embodiment 4

Figure 8:
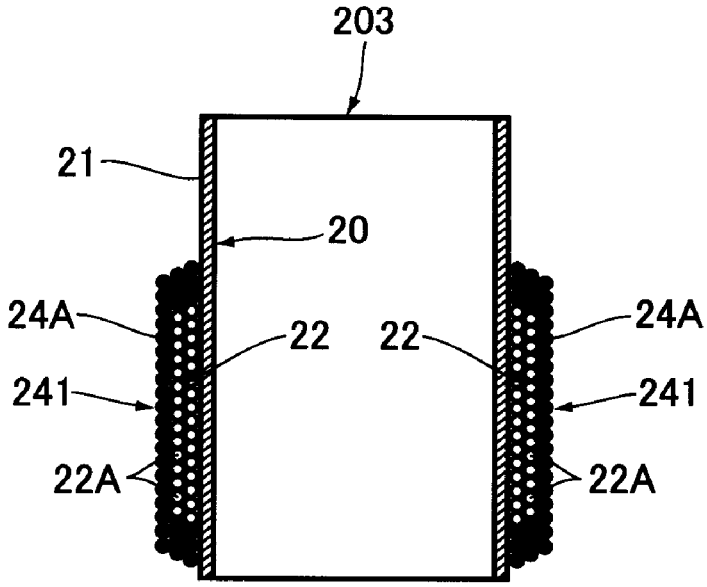
FIG. 8 is a sectional view of a speaker voice coil different from the foregoing embodiments.

Next, embodiment 4 of the present invention will be described in detail with reference to FIG. 8. FIG. 8 is a sectional view of a voice coil different from the foregoing embodiments.

This voice coil 203 has a reinforcing wire winding part 241 in which the reinforcing wire 24A is wound around the voice coil bobbin 21 in contact with both coil ends of the wire winding part 22 of the voice coil bobbin 21. The wire winding part 22 is also covered with the reinforcing wire 24A wound around the voice coil bobbin 21.

The reinforcing wire winding part 241 is not necessarily limited to the configuration of covering both coil ends of the wire winding part 22 and the wire winding part 22. For example, the reinforcing wire 24A may be wound around the voice coil bobbin 21 so that it is in contact with the lower coil end of the wire winding part 22 in the diagram (on the magnetic-circuit side) and covers the wire winding part 22. It should be noted that the portion of the reinforcing wire 24A where to cover the wire winding part 22 is desirably excluded from the heat treatment, solvent treatment, or adhesive treatment, so that heat decomposition gas occurring from the wire 22A is released to the air through gaps between the turns of the reinforcing wire 24A.

According to the foregoing configuration, the wire winding part 22 is firmly held at both coil ends or at the lower end by the reinforcing wire winding part 241, and is thus prevented from shifting from its initial mounting position. Consequently, the possibility for the wire winding part 22 to cause disconnection or come off the voice coil bobbin 21 is lowered significantly even if the voice coil 203 produces heat due to high input until the resin coating of the wire 22A is thermally broken and the wire binding of the wire winding part 22 or the binding with the voice coil bobbin 21 becomes loose. In addition, even if the resin coating of the wire 22A covered with the reinforcing wire winding part 241 is heated by Joule heat, heat decomposition gas caused by the wire 22A is released to the air through gaps between the turns of the reinforcing wire 24A in the reinforcing wire winding part 241. This precludes the reinforcing wire winding part 241 from bulging out.

Since the reinforcing wire 24A is wound around the voice coil bobbin 21, the voice coil 203 has improved rigidity and can suppress split resonance. The manufacturing cost can also be reduced since the lower end of the voice coil bobbin 21 need not be bent outward.

Embodiment 5

Figure 9A:
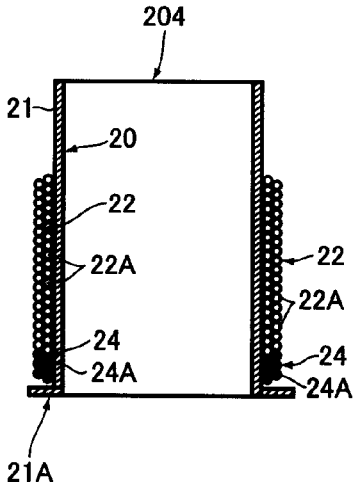
FIGS. 9A to 9C are sectional views of speaker voice coils whose lower ends are bent to turn sideways at a near right angle.
Figure 9B:
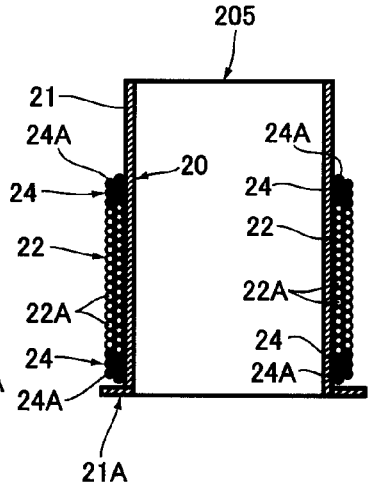
Figure 9C:
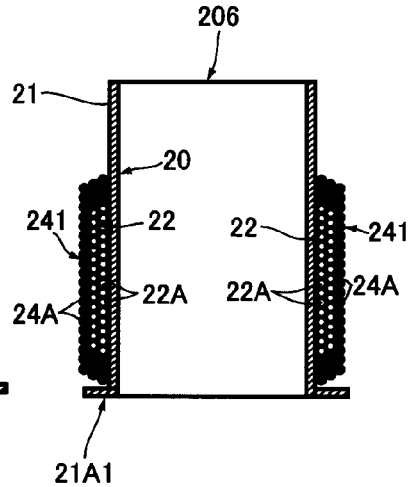

Next, embodiment 5 of the present invention will be described in detail with reference to FIGS. 9A to 9C. FIGS. 9A to 9C are sectional views of a voice coil different from the foregoing embodiments.

As shown in FIG. 9A, a voice coil 204 has a reinforcing wire winding part 24 in which a reinforcing wire 24A nonconductive with the wire 22A is wound around the voice coil bobbin 21 in contact with the lower coil end of the wire winding part 22 (on the magnetic-circuit side). The winding of the reinforcing wire 24A is fixed by heat treatment or solvent treatment such as current heating, furnacing, hot-air fusing, and alcohol fusing, or with an adhesive.

In a voice coil 205, as shown in FIG. 9B, reinforcing wire winding parts 24 are formed on both coil ends of the wire winding part 22 on the voice coil bobbin 21.

In a voice coil 206, as shown in FIG. 9C, a reinforcing wire winding part 241 is wound around the voice coil bobbin 21 in contact with both coil ends of the wire winding part 22. The wire winding part 22 is also covered with the reinforcing wire winding part 241.

A bent portion 21A is integrally formed on each of the voice coil bobbins 21 of these voice coils 204 to 206. The bent portion 21A is bent outward to turn sideways at a near right angle.

According to the foregoing configuration, the wire winding parts 22 are firmly held at both coil ends or at the lower coil end by the reinforcing wire winding part(s) 24 or 241, and thus are prevented from shifting from their initial mounting positions. Moreover, the lower ends of the voice coil bobbins 21 of the voice coils 204 to 206 are provided with the bent portions 21A which are bent outward to turn sideways at a near right angle. These bent portions 21A prevent the wire winding parts 22 from coming off to the magnetic-circuit side. This gives the voice coil bobbins 21 a structure more resistant to the coming-off of the wire winding parts 22. In the resulting voice coils 204 to 206, the wire winding parts 22 hardly cause disconnection or come off the voice coil bobbins 21 even if the voice coils 204 to 206 generate heat due to high input until the wire bindings of the wire winding parts 22 become loose. Since the voice coil bobbins 21 need not be bent so as to accommodate the entire wire winding parts 22, the outward bends on the lower ends of the voice coil bobbins 21 can be formed without much increase in manufacturing cost.

Embodiment 6

Figure 10A:
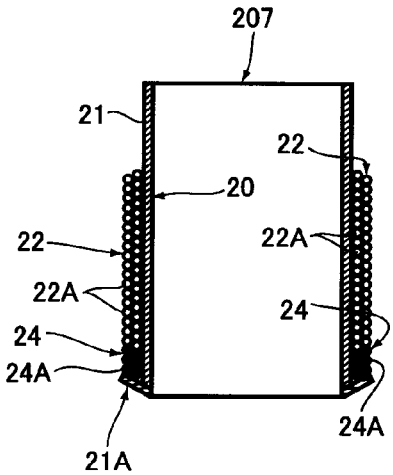
FIG. 10A is a sectional view of a speaker voice coil whose lower end is folded into contact with a reinforcing wire winding part.
Figure 10B:
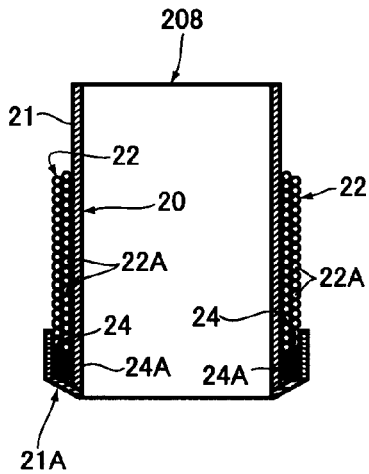
FIG. 10B is a sectional view of a speaker voice coil whose lower end is folded to accommodate a reinforcing wire winding part.

Next, embodiment 6 of the present invention will be described in detail with reference to FIGS. 10A and 10B. FIGS. 10A and 10B are sectional views of voice coils different from the foregoing embodiments.

As shown in FIGS. 10A and 10B, voice coils 207 and 208 each have a reinforcing wire winding part 24 in which a reinforcing wire 24A nonconductive with the wire 22A is wound around the voice coil bobbin 21 in contact with a coil end of the wire winding part 22 on the magnetic-circuit side. The winding of the reinforcing wire 24A is fixed by heat treatment or solvent treatment such as current heating, furnacing, hot-air fusing, and alcohol fusing, or with an adhesive. The reinforcing wire winding part 24 may be wound on both ends of the wire winding part 22 (see FIG. 11A). The reinforcing wire winding part 24 may be replaced with a reinforcing wire winding part 241 that covers the wire winding part 22.

As shown in FIG. 10A, the bent portion 21A that is integrally formed on an end of the voice coil 207 on the magnetic-circuit side is folded into contact with the reinforcing wire winding part 24 wound around the lower end of the wire winding part 22.

As shown in FIG. 10B, the bent portion 21A that is integrally formed on an end of the voice coil 208 on the magnetic-circuit side is folded to accommodate the reinforcing wire winding part 24 wound around the lower end of the wire winding part 22.

According to the foregoing configuration, each wire winding part 22 is firmly held at both coil ends or at the lower coil end by the reinforcing wire winding part 24, and is thus prevented from shifting from its initial mounting position. Besides, the bent portion 21A is folded into contact with the reinforcing wire winding part 24 wound around the lower end of the wire winding part 22, or folded to accommodate the reinforcing wire winding part 24 wound around the lower end of wire winding part 22. The formation of such bent portions 21A prevents the wire winding parts 22 from coming off to the magnetic-circuit side. This gives the voice coil bobbins 21 a structure more resistant to the coming-off of the wire winding part 22. In the resulting voice coils 207 and 208, the wire winding parts 22 hardly cause disconnection or come off the voice coil bobbins 21 even if the voice coils 207 and 208 generate heat due to high input until the wire bindings of the wire winding parts 22 becomes loose.

The voice coil bobbins 21 need not be bent so as to accommodate the entire wire winding parts 22. In the resulting voice coils 207 and 208, the outward bends on the lower ends of the voice coil bobbins 21 can thus be formed without much increase in manufacturing cost.

Moreover, even if the voice coil bobbins 21 of the voice coils 207 to 208 are made of a hard metal such as titanium, the reinforcing wire winding parts 24 might but the wire winding parts 22 will not be damaged by the bending of the voice coil bobbins 21.

Embodiment 7

Figure 11A:
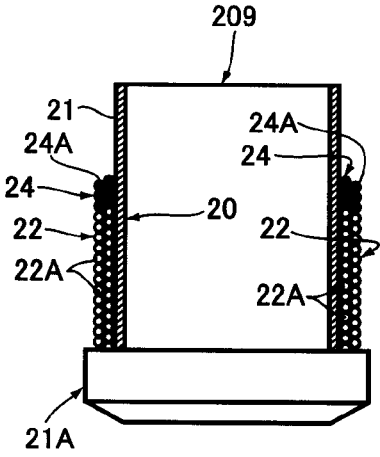
FIG. 11A is a side view of the bent portion of a speaker voice coil which is folded to accommodate a reinforcing wire part.
Figure 11B:
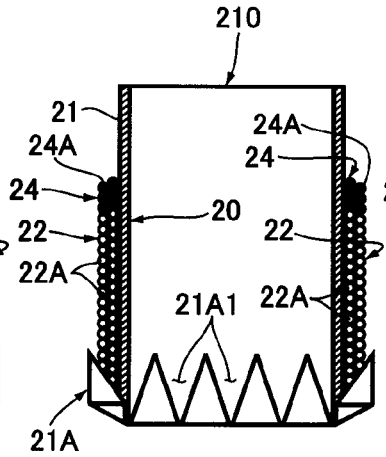
FIG. 11B is a side view of the bent portion of a speaker voice coil which has triangular slits.
Figure 11C:
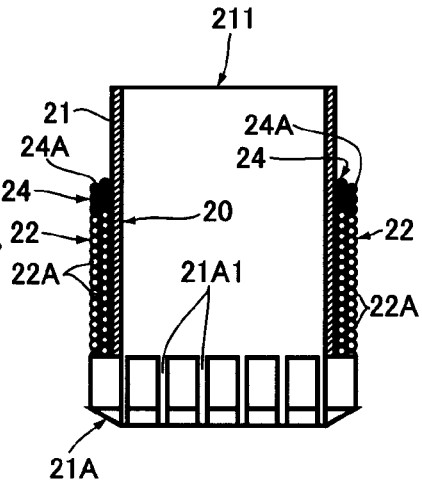
FIG. 11C is a side view of the bent portion of a speaker voice coil which has straight slits.

Next, embodiment 7 of the present invention will be described in detail with reference to FIGS. 11A to 11C. FIGS. 11A to 11C are sectional views of voice coils different from the foregoing embodiments.

As shown in FIG. 11A, a voice coil 209 has a reinforcing wire winding part 24 in which a reinforcing wire 24A nonconductive with the wire 22A is wound around the voice coil bobbin 21 in contact with both coil ends of the wire winding part 22. The winding of the reinforcing wire 24A is fixed by heat treatment or solvent treatment such as current heating, furnacing, hot-air fusing, and alcohol fusing, or with an adhesive. The reinforcing wire winding part 24 may be wound on the end of the wire winding part 22 on the magnetic-circuit side alone (see FIG. 9A). The reinforcing wire winding part 24 may be replaced with a reinforcing wire winding part 241 that covers the wire winding part 22 (see FIG. 9C).

The end of this voice coil bobbin 21 on the magnetic-circuit side is bent into a bent portion 21A. This bent portion 21A is folded so as to accommodate the reinforcing wire winding part 24, which is a winding wound in contact with the lower end of the wire winding part 22. FIG. 11B shows a voice coil 210 in which triangular slits 21A1 are formed in the bent portion 21A. FIG. 11C shows a voice coil 211 in which straight slits 21A1 are formed radially in the bent portion 21A.

Note that the slits 21A1 are necessarily formed in the bent portions 21A that are folded to accommodate the reinforcing wire winding part 24 wound around the lower end of the wire winding part 22. Slits may also be formed in a bent portion 21A that is bent to turn sideways at a near right angle, and one that is folded into contact with the reinforcing wire winding part 24 wound around the lower end of the wire winding part 22.

According to the foregoing configuration, the wire winding parts 22 are firmly held at both coil ends or at the lower coil end by the reinforcing wire winding parts 24, and are thus prevented from shifting from their initial mounting positions. Besides, the bent portions 21A folded to accommodate the reinforcing wire winding parts 24 wound around the lower ends of the respective wire winding parts 22 are formed on the lower ends of the voice coil bobbins 21. These bent portions 21A prevent the wire winding parts 22 from coming off to the magnetic-circuit side. This gives the voice coil bobbins 21 a structure more resistant to the coming-off of the wire winding parts 22. In the resulting voice coils 210 and 211, the wire winding parts 22 hardly cause disconnection or come off the voice coil bobbins 21 even if the voice coils 210 and 211 produce heat due to high input until the wire bindings of the wire winding parts 22 becomes loose.

Moreover, the bent portions 21A have triangular or straight slits 21A1. This avoids the occurrence of eddy currents and reduces mechanical resistances significantly when the voice coil bobbins 21 are made of conductive material. The resulting voice coils 210 and 211 can thus make extremely smooth operations.

Moreover, since the slits 21A1 are formed in the lower ends of the voice coil bobbins 21 before making the bent portions 21A, the lower ends of the voice coil bobbins 21 can be folded easily even if the voice coil bobbins 21 are made of a hard metal such as titanium. In addition, even when the bent portion 21A is formed on the lower end of the voice coil bobbin 21, the slits 21A1 can reduce the weight of the voice coil bobbin 21.

In the voice coils 204 to 211 according to the foregoing embodiments 5 to 7, the reinforcing wire 24A may be replaced with such a winding wire material as a heat resistant fiber thread 23A.

Moreover, the reinforcing wire winding part 24 or the thread winding part 23 may be formed only on an end of the voice coil bobbin 21 different from the magnetic-circuit side, i.e., on the diaphragm side. In this case, if the voice coil bobbin 21 is made of a hard metal such as titanium, the wire winding part 22 may be damaged when the bent portion 21A is formed by bending. Then, the reinforcing wire 24A or the heat resistant fiber thread 23A may be wound around fragile locations of the wire winding part 22 in advance, so that the wire winding part 22 is protected while the wire reinforcing wire 24A or the heat resistant fiber thread 23A alone is subject to damage.

Note that the foregoing materials and substances have been mentioned solely by way of representative example, and not restrictive. That is, the present invention may use materials and substances other than the foregoing. For example, a combination or strand of a plurality of materials or threads may be used. The type, the thickness, the number of turns, and the way of winding of the thread, as well as the resin materials, are preferably determined depending on such factors as the required performance and sound quality of the speaker.

Moreover, the present invention is not limited to embodiments 1 to 7, and modifications may be made thereto without departing from the gist of the present invention.

Furthermore, according to cone speakers 100 using any of the voice coils 200 to 211 of the present invention, the possibility for the wire winding part 22 to cause disconnection or come off the voice coil bobbin 21 becomes low. It is therefore possible to obtain stable sound quality over a long period of time, with excellent durability and high maximum input. Since the voice coils 200 to 211 have improved rigidity, it is possible to suppress split resonance and obtain reproduced sound with little distortion.

It should be appreciated that the application of the present invention is not limited to cone speakers. For example, the present invention may also be applied to dome speakers, voice coil motors, pickup coils, etc.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A speaker voice coil comprising:

a wire winding part formed by winding a resin-coated wire around a voice coil bobbin; and a reinforcing wire winding part comprising a reinforcing wire wound around the voice coil bobbin;

wherein the reinforcing wire is wound around the voice coil bobbin so that only a coil end of the wire winding part is contacted by the reinforcing wire winding part;

wherein the reinforcing wire physically contacts the wire winding part without electrically conducting with the wire winding part;

and wherein the winding of the reinforcing wire is fixed by heat treatment, by solvent treatment, or with an adhesive.

2. The speaker voice coil according to claim 1, wherein said reinforcing wire is a self-fusing wire having a fusing layer on its periphery.

3. The speaker voice coil according to claim 1, wherein said reinforcing wire is either a naked wire or an insulated wire.

4. A speaker voice coil comprising:

a wire winding part formed by winding a resin-coated wire around a voice coil bobbin; and a reinforcing wire winding part comprising a reinforcing wire wound around the voice coil bobbin;

wherein the reinforcing wire is wound around the voice coil bobbin so that only a coil end of the wire winding part is contacted by the reinforcing wire winding part;

wherein the reinforcing wire physically contacts the wire winding part without electrically conducting with the wire winding part; and wherein an end of the voice coil bobbin is bent outward to form a bent portion.

5. The speaker voice coil according to claim 4, wherein said reinforcing wire is a self-fusing wire having a fusing layer on its periphery.

6. The speaker voice coil according to claim 4, wherein said reinforcing wire is either a naked wire or an insulated wire.

7. The speaker voice coil according to claim 1, wherein a bent portion bent outward is formed on one end of said voice coil bobbin.

8. The speaker voice coil according to claim 4, wherein the bent portion on the end of the voice coil bobbin is formed by any one of:

bending the end of the voice coil bobbin to avoid electrical conductance between the voice coil bobbin and the reinforcing wire bending the end of the voice coil bobbin to provide electrical conductance between the voice coil bobbin and the reinforcing wire; and bending the end of the voice coil bobbin to provide electrical conductance between the voice coil bobbin and both the reinforcing wire and the wire winding part.

* * * * *